US007249911B2

(12) United States Patent
Hyams

(10) Patent No.: US 7,249,911 B2
(45) Date of Patent: Jul. 31, 2007

(54) DETECTABLE WARNING-DOTS DEMARKATION FOR PEDESTRIAN SAFETY

(76) Inventor: Christopher A. Hyams, 802 Denise La., El Cajon, CA (US) 92020

( * ) Notice: Subject to any disclaimer, the term of this patent is extended or adjusted under 35 U.S.C. 154(b) by 0 days.

(21) Appl. No.: 10/923,761

(22) Filed: Aug. 23, 2004

(65) Prior Publication Data

US 2006/0039752 A1 Feb. 23, 2006

(51) Int. Cl.
*E01F 9/06* (2006.01)
*E01F 9/053* (2006.01)
*E01F 9/04* (2006.01)

(52) U.S. Cl. ..... 404/15

(58) Field of Classification Search ..... 404/12–16, 404/19

See application file for complete search history.

(56) References Cited

U.S. PATENT DOCUMENTS

| | | | | | |
|---|---|---|---|---|---|
| 1,698,594 | A | | 1/1929 | Hoff | 404/15 |
| 2,180,105 | A | | 11/1939 | Farrell | 404/9 |
| 2,635,513 | A | | 4/1953 | Batterson | 404/15 |
| 4,620,816 | A | * | 11/1986 | Kupfer | 404/6 |
| 5,104,256 | A | * | 4/1992 | D'Avela | 404/14 |
| 5,217,319 | A | * | 6/1993 | Klohn | 404/15 |
| 5,271,690 | A | * | 12/1993 | Fennessy, Sr. | 404/9 |
| 5,302,049 | A | * | 4/1994 | Schmanski | 404/42 |
| 5,320,790 | A | | 6/1994 | Lowe | 264/31 |
| 5,328,293 | A | * | 7/1994 | Keefe | 404/9 |
| 5,354,143 | A | * | 10/1994 | Lindner | 404/9 |
| 5,385,770 | A | | 1/1995 | Julnes | 428/195 |
| 5,513,924 | A | * | 5/1996 | Alghunaim | 404/14 |
| 5,827,009 | A | * | 10/1998 | Kokoletsos | 404/75 |
| 6,068,083 | A | * | 5/2000 | Takahashi | 182/92 |
| 6,449,790 | B1 | * | 9/2002 | Szekely | 14/69.5 |
| 6,709,191 | B1 | * | 3/2004 | McCuskey | 404/19 |
| 6,890,124 | B2 | * | 5/2005 | Provenzano, III | 404/73 |
| 2003/0037720 | A1 | | 2/2003 | Stocton | 116/205 |
| 2004/0042850 | A1 | | 3/2004 | Provenzano | 404/34 |
| 2004/0067336 | A1 | | 4/2004 | Munroe | 428/131 |
| 2005/0031415 | A1 | * | 2/2005 | Sippola | 404/93 |

FOREIGN PATENT DOCUMENTS

JP 5-321214 * 5/1992

OTHER PUBLICATIONS

Applicant's USPTO/Disclosure Document #545,452, filed on: Jan. 20, 2004, entitled: "Detectable Warning-dots Demarkation for Pedestrian Safety".

* cited by examiner

*Primary Examiner*—Raymond Addie
(74) *Attorney, Agent, or Firm*—Charles C. Logan, II

(57) ABSTRACT

A novel small quasi-hemispherical truncated-dome modular-dot like device, which can be readily affixed to pavement in a Federally-mandated pattern via a special hole/matrix-stencil;—the resulting demarkations thereby serving to alert the Legally-blind (as well as Guide-dogs, persons in wheelchairs, and otherwise pre-occupied non-handicapped individuals) their pedestrian-pathway is entering into a potentially dangerous transition area typically crossed by a motor-vehicle pathway. The individual so called DW-DOTS™ are resilient circular low-profile devices having an annular-ramp configuration, and thus standing out only sufficiently above a foot-surface as to enable foot-tactile detection, yet not pose the potential tripping hazzard known to embedded-mats. This novel safety-button offers a desired permanent contrasting-color, plus has a definition and rugged permanency not known to poured-dot installations. The disclosure sets forth various generic-variant structural embodiments, as well as the preferred method of attachment to a walkway-pavement surface.

1 Claim, 4 Drawing Sheets

DETECTABLE WARNING-DOTS DEMARKATION FOR PEDESTRIAN SAFETY

BACKGROUND OF THE INVENTION

1. Field of Invention

This invention relates to device and method for guiding the visually-impaired pedestrian relative to danger-zones such as vehicular crossings proximal paved walkways; and more specifically, it relates to those types of apparatus devised with raised foot-tactile demarcations.

2. Background History

With increased awareness as to the need for improved safety precautions for the estimated 12-million persons having varying degrees of disabling sight impairment, on 26Jul. 1991, the U.S.Congress published federally legislated Regulation—US/CFR-Parts: 35 & 36 (Re: gov.structures & pvt.structures respectively) regarding actual implementation of truncated-domes, which regulation was ushered in by the U.S. Justice Dept. via their truncated-domes, which regulation was ushered in by the U.S. Justice Dept. via their ADA/Americans w/Disabilities Act Dept. (Re: tech.info: www.access-board.gov);-however the Fed.DOT/Dept.-Of-Transportation also has its jurisdiction governing installation of these truncated-comes relative to transit/boarding-platforms, etc. This regulation addresses numerous federal-requirements regarding access to both public-facilities (state & local) and private-facilities, -by the disabled. While the ADA & DOT timetable requirements for govermental facilities to adopt the installation of truncated-domes upon walkways appears as of yet unspecified, the requirement for privately-owned facilities open to the public has been fairly clearly mandated (although subject to refinement owing experience being gained by actual usage). Here, all new/private-buildings considered generally accessable by the public, were, effective 26 Jan. 1993, required to comply with the ADA-regulation defining specific installation as to the physical configuration of foot-tactile detectable-warning means. The Federal-specifications mandated the size of truncated-dome formations to be provided upon the walking-surface of street curb-ramps and a walking-surface proximal a vehicular-way or other danger-zone (ie: reflecting-pool, or boarding-platform) not otherwise separated by a curb or railing. Detectable-warning means for paved-walkways are generally defined as: "a standardized integral surface built-in or overlaid in a permanent manner, and are presently to be finished in a mono-chromatic color (ie:—yellow) that would contrast with adjacent walkway surfacing. Moreover, the truncated-dome (TD) entities are presently decreed to have a nominal 0.90"-1.40" diameter (at base), nominal 0.20"/height (above base), and nominal 0.45"/flat-top portion, plus center-to-center 1.67"/interval-spacing (hence a 2.35"/interval-spacing measuring diagonally between rows of TD's),—which therefore equates to a 7×7 TD-matrix format within a given conventional 12"×12"-square paving-tile for example; and Installation of the TD/paving-tiles are thus formatted in walkway-widths of 24", 36", or 48". Note that while not exempting the novel TD configuration being introduced by this instant disclosure, the Federal-regulations actually had no anticipation of my novel embodiment;—owing that heretofore the TD's only were known to be molded integrally with rubber-like paving-tiles, cast integrally as nodules extending above a cementous surface, or applied in the form of a moltant catalyzed-resin which would harden in-place upon a walkway (this last iteration being applied as, blobs of epoxy basically,—therefore not accurately meeting the Fed.—requirements dimensionally).

3. Relevant Prior-Art

Research discovery provides some prior patent-art regarded as germane to this disclosure, chronologically for example U.S. Pat. No. 1,469,146 (filed: August 1922 issued to L. J. Betts) is shown a motor-vehicle traffic-marker device which is truncated in formation, thereby presenting a dome like face whilst its substantially planar bottom-side includes means by which the device is mechanically bolted to the street surface. Other similar such improved devices were subsequently patented, whereupon in the late 1940's a CalTrans/R&D-technician Elbert D. Botts invented (although never patented) a durable night and rain visible white-ceramic approximately 3½-inch diameter truncated-dome device which was installed as non-intrusive median-markrs down the center of California's highways. At speed, these devices would interact with the vehicle's tire in such a way as to generate an alarming vibration that would both audibly and vibrationally alert the perhaps drowsy motorist that they had better move their dangerously drifting vehicle back into their proper lane of travel. However, median streams of these early RPM's (reflective pavement markers) as Botts called them, were retained into the road-surface via an integral-spike which proved to be impractical in as much as once they had worked loose over time from tire-impacts,—they became terrible road hazards in of themselves. In the early 1950's a viable solution to this installation calamity was posed by H. Rooney an understudy of Botts,—which was to simply affix the Dot devices with a tough new cementing-agent Epoxy-resin (this notion was never patented either). Thus CalTrans evaluation resumed during the 1950's, unfortunately Dr. Botts (Phd.-Chemistry) died before he could see the popular implementation of their utterly simple albeit exceptionally effective road-safety idea which has indeed saved millons of lives,—yet he is honored today by their being appreciatively referred to as "Botts Dots"!

Then in U.S. Pat. No. 1,647,861 (filed: June 1925) is shown a Street-button made of stamped-steel, having four downwardly projecting integrally formed legs which are driven into the asphaltum or yet uncured cementous street-surface for positive retention. Although no mention was set forth as to the notion of foot-tactility detectable to the blind, to negate a pedestrian slipping thereon, the exposed top-surface of the Street-button was substantially flush with the pavement-top, and included a matrix of nine tiny embossed convex nodules which projected upward about ⅛-inch. The devices were intended to be installed along the existing painted white-stripping used to delineate pedestrian/cross-walks; and as such, were considered by the inventor to be more durable and lasting as compared to painted-demarcations.

Later in U.S. Pat. No. 4,715,743 (filed: June 1986) and in U.S. Pat. No. 5,303,669 (field: September 1992) is shown an abutted array of flexile tile panels composed of a generally yellow-colored synthetic-rubber like material upon which upwardly facing side is integrally-molded a plurality of foot-tactile truncated nodules functioning as detectable-warning elements capable of assisting the visually-handicapped to know they are proximal a hazardous zone where vehicles travel, or are traversing a trolly/loading-platform for example. However, these tiles have a thickness requiring they be installed into a planar-recess, and recent studies have shown these tiles can in of themselves pose a potentially serious tripping hazard to all pedestrians as the tiles become aged;—whereby their perimeter-edges sometimes protrude upward from their normally flush-mounted condition, whereupon a person can stub the toe of their shoe and suddenly stumble to an injurious fall.

Next, in U.S. Pat. No. 5,271,690 (filed: February 1992) and U.S. Pat. No. 5,320,790 (filed: July 1992) are set forth similar methods for producing a durable foot-tactile detectable-warning surface, and as such, contemplate a female-embossed pattern means by which to overlay an existing pavement-surface with plural detectable-warning nodules,—or otherwise like impressions cast into the top surface of a completely new sidewalk for example. Accordingly, the resulting tactlized surface is thus all integrally formed with the spaced apart nodules, which is durable, yet is generally rather costly owing that an existing sidewalk area to have the requisite detectable-warning surface would usually have to be entirely replaced in order that the final new surface remain flush with the adjoining sidewalk surfaces.

In pending U.S. Pat. No. 2003/0037720 (filed: August 2002) is shown a detectable-warning and directional-guidance apparatus and method, in the form of uniformly spaced apart elongate ABS-plastic (ie: Fed.DOT-approved Centrex®—brand) marker elements arranged in parallel groups bonded to the existing pavement by epoxy-adhesive (ie: Fed.-DOT approved EAS-6);—the notion being to thereby orient a visually-impaired pedestrian to proceed in the azimuth direction referenced by the linearity of the 24-inch long×1-inch wide strips. Recent findings by the U.S. Accessibiiities Board indicates that this particular elongated form of detectable-warning device has failed to function well with the special Blind-cane which emits a sonar like signal that is monitored by the blind user.

Therefore, in full consideration of the preceding patent review, there is determined a need for an improved form of device to which these patents have been largely addressed. The instant inventor hereof believes their newly improved pavement safety device, commercially referred to as D.W.DOTS™, currently being developed for production under auspices of the AmBrit-Mfg./Mkt.-LLC (website: "www.dwdots.com") exhibits certain advantages as shall be revealed in the subsequent portion of this instant disclosure.

SUMMARY OF THE INVENTION

A.) In view of the foregoing discussion about the earlier invention art, it is therefore important to make it pellucid to others interested in this art, that the object of my invention is to provide a foot-tactile detectable-warning safety-button device cooperatively utilizing the existing walkway-pavement as a foot-tactile warning-field, serving particularly for cautioning of the visually-impaired (ie:—sight impairment ranging from low-level of vision to the totally-blind) pedestrian traversing walkways that for example may be located proximal an intersecting vehicular-pathway or loading-zone (ie:—such as for roller-skate'ers, bicycles, motorcars, trucks, bus, or rail-transit). Moreover, while assisting the visually-impaired is this instant disclosure's prime concern, it has been found that the average fully-sighted pedestrian who may be simply preoccupied with the days events, may also benefit by being similarly foot-tactilly alerted to their need for caution as to where they are proceeding. Furthermore, I have discovered that my subject invention is also useful in creating walkway-graphics, such as the delineation of advisory-wording (ie: "entrance", "exit", "welcome", "no-parking:,—etc.), as well as outlined-delineation of advisory-symbols (ie: arrows, wheelchair); plus, can be arranged in a continuous stream of dot-matrix linear-delineations as guide-lines for both the unsighted and fully-sighted pedestrian to follow toward some destination such as an exit.

B.) Another object of this invention disclosure is to specifically set forth my particular embodiment for a truncated-dome device in the form of rigid and durable safety-button prefabricated of an injection-molded conventional high-impact polymer-resin material, and having a nominal diameter range of ¾"–1½" breadth, and employing a nominal thickness (approximate installed height above existing walkway) range of 3⁄16"–5⁄16", with a substantially flat apex portion, which range is nominally about ⅜"–1" in diameter or breadth. This physically translates as a safety-button having a semi-hemispherically domed top-side, with a central apex portion which is preferably planar and parallel to its bottom-side; and moreover, which upper side surface is semi-conically shaped by virtue of its beveled circular perimeter. Furthermore, my safety-button device can optionally exhibit a top-side which in plan-view is multi-faceted in the form of a regular-polyhedron shape such as a decahedron type of decagon, which can also include an apex portion which rises to a central point. Hence, the shape of my truncated-dome detectable-warning device can even be a pyramid like shape, therefore not necessarily smoothly circular in plan-view.

Additionally, it is preferred that the apex portion be embossed with a centered X-shaped channel, serving to provide improved pedestrian foot traction when stepped upon. While it is preferred that my safety-button device be generally installed in a geometric format having a regular installed center-to-center spacing interval of about 1⅝" (measured linearly) or 2⅜" (measured diagonally);—it nevertheless is understood that various other sorts of geometric patterns may be resorted to as well.

Another important feature of my safety-button device, is the provision of an improved bottom-side surface, to enhance the tenacity by which the safety-button holds to the surface of an existing walkway. One option is to coarse-sandblast the cavity portion of the female-die in which my plastic safety-button is molded, thereby transfering the texture to the bottom-surface of the injection-molded piece. However, in order to negate any thus resulting skin-like sheen, it is ultimately preferred that the safety-button itself be directly sandblasted post-molded, as to thereby present the best attainable "tooth" to which the subsequently applied intermediate substrate bonding-agent can adhere; and hence, thereby promote greater bonding-strength between the safety-button relative to the pavement. Yet another optional approach toward attaining a permanently fixed attachment to the walkway pavement surface, is to prepare the die-mold with a raised-embossment in the form of concentric circles, which also preferably includes a centrally superimposed X-formation; which results in a finished part having the identical formations in reverse relief. The bottom-side of the molded safety-button would thus exhibit a series of concentric circular channels in combination with the X-formation; the latter portion of the channeling thereby serving to actually vent-off any air or surplus bonding-agent prior to the bonding-agent curing into a hard substrate.

An alternate embodiment for the safety-button's bottom-side, is to employ an annular-boss proximal the perimeter of the safety-button, the annular-boss necessarily employing an angled-undercut ledge forming a slight annular-declivity into which the bonding-agent substrate can migrate while curing;—thereby achieving a positive mechanical retention of the safety-button relative to the supporting pavement. This ledge need be only approximately 1⁄16"-deep, so an annular-declivity having an approximate 30-degree undercut, would be easily extracted from the female-die while the post-molded cooling part is still semi-moltant, and therefore sufficiently compliant as to yield to the extraction process popping the part out of the female-die to be ready for the next rapid cycling of the injection-molding procedure. Here, it is also preferred that the annular-boss be provided with three equidistantly spaced apart radial-slots, whereby excess bonding-agent can ooze and any captive air can readily vent from beneath the walkway-pavement installed safety-button prior to catylized-hardening of the bonding-agent.

Another iteration option of safety-button is configuring the bottom-side with a concavity into which the bonding-agent substrate can flow during installation upon the walkway-pavement, which has been discovered to provide a slightly more compliant, and hence softer harmonic tonal-quality when tapped with a blind person's guide-cane. This tonal characteristic, while considered desirable by the ADA to enhance detection by cane-tip, is not a requsite criteria. An uppermost venting-port can also be included in this version of my safety-button, through which excess premixed fluid bonding-agent can spew; thereby eliminating any entrapped-air.

C.) Another object of this invention disclosure is to specifically set forth my particular embodiment for a truncated-dome device according to preceeding items-A&B, whereof I also prefer to employ a novel pre-fabricated method of geometrically installing my safety-buttons in a precisely spaced apart plurality upon an existing walkway-pavement area. My method utilizes a specially made layout-stencil sheet preferably made from approximately 1/16"-gauge thickness polyethylene (or the practical equivalent), into which a plurality of safety-button placement marker-holes have been made by a computerized/hole-punching machine (thereby obviating need of a costly hole/cutting-die. The purpose of this special hole/marking-stencil being to simply lay out the stencil upon the walkway-pavement surface designated for installation of perhaps hundreds of my safety-button devices. With the hole/marking-stencil held in the properly determined position by duct-tape or positioning-weights, the installation-workman then simply deposits a measured gooey-dab of premixed bonding-agent upon the up-ended underside of an individual safety-button, and then over-turning the safety-button, inserts it through the hole/marking-stencil's demarcated position upon the walkway-pavement. Alternately, a faster technique is to initially apply a like amount of the premixed bonding-agent into the targeted points demarcated by the hole/marking-stencil;—then proceed to simply press a safety-button down firmly in place upon each of the hole demarcated locations. Upon completion of the described safety-button installation procedure, the hole/marking-stencil is simply lifted-away, leaving only the neat and clean, precisely aligned, plurality of safety-buttons.

As was mentioned in Item-B, the ADA & DOT—regulations require TD's to be located in a geometric format having a regular installed center-to-center spacing interval of about 1⅝" (measured linearly) or 2⅜" (measured diagonally);—it nevertheless is understood that various other sorts of geometric patterns may be resorted to as well by my afore stated method. Finally, it should be mentioned that the ADA & DOT—regulations are presently at odds as to weather the entire installed detectable-warning field should be finished in a visually-contrasting bright-yellow, or the DW-field finished with black-on-yellow or yellow-on-black truncated-domes;—nevertheless my device and method is readily capable of complying with any ultimately determined installation appearance, as I can mold my safety-button devices in either bright-yellow or black so as to either match or contrast with the walkway-pavement's coloration (which may be administered by a conventional traffic-durable paint paint).

D.) Another object of this invention disclosure is to specifically set forth my particular embodiment for a truncated-dome device according to preceeding Items-A, B&C, wherein another optional embodiment is to employ an annular-groove around the upper perimeter of the safety-button serving to receive a substantially conventional retro-reflective ring member; whereby ambient light or light casting upon the field array of safety-buttons will make the field of detectable-warning safety-buttons appear luminous to an approaching pedestrian or vehicle. The retro-reflective ring is a plastic mono-filament like ring which is coated with a reflective-substrate, and simply snaps into the annular-groove.

DESCRIPTION OF THE PREFERRED EMBODIMENT DRAWINGS

The foregoing and still other objects of this invention will become fully apparent, along with various advantages and features of novelty residing in the present embodiments, from study of the following description of the generic species embodiments and study of the ensuing description of these embodiments. Wherein indicia of reference are shown to match a particular feature stated in the text, as well as the claims section annexed hereto; and accordingly, a better understanding of the invention and the variant uses is intended, by reference to the drawings, which are considered as primarily exemplary and not to be therefore construed as restrictive in nature; wherein:

DETAILED DESCRIPTION OF THE PREFERRED EMBODIMENTS

Figure 1A:
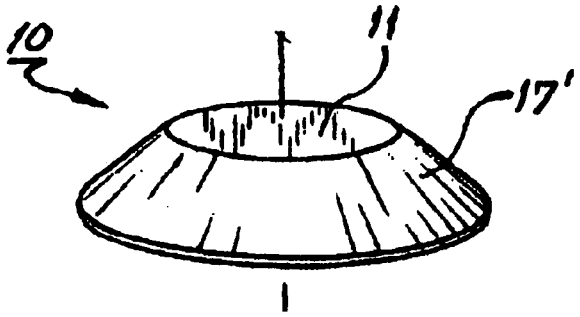
FIG. 1A, is an pictorial-view favoring the top of my basic safety-button device.

Initial reference is given by way of FIG'S.-1A/1B/1C wherein is exhibited an example of the most basic embodiment of my safety-button invention device 10, shown here having a preferred planar apex-surface 11, and a preferably straight sloped perimeter side-wall surface 17" formed contiguously between shown circular apex reference-plane perimeter 11" and base/perimenter-edge portion 17 which is contiguously formed with preferred planar bottom-side 19 preferably having a coarse-textured surface finish 19' best achieved by direct sand-basting, for maximum adherence of the bonding-agent 12). The beveled slope is preferably inclined less than 45-degrees toward 30-degrees (angle referenced up from bottom-side surface plane 19 of FIG. 1C),—so as to thereby make the safety-buttons more resistant to inadvertent shoe-stubbing (or even actual malicious kicking), owing that such physical impacts are much more easily deflicted as compared to a more steeply inclined pitch (ie: toward 60-degrees). My basic safety-button devices 10 are shown employed in FIG. 1C by permanently installing them directly upon any clean pedestrian-walkway surface typified at 13 via an interfacing bonding-agent substrate 12.

While it is generally preferred that my safety-button devices 10 be inexpensively injection-molded of a polymer-material, such as a conventional high-impact styrene based plastic with integral coloration (ie: genereally bright-yellow, black, or med.-blue),—in a preferably multi-cavity injection-molding die; they can also be very cost-effectively CNC-machined (or screw-machine produced) automatically from conventional extruded-aluminum bar-stock; and if desired, finished in a durable gold, black, or blue anodized finish. Moreover, for those installations where the ultimate in quality appearance is desired such as a detectable-warning device installation proximal a five-star hotel, my D.W.DOTS™ can even be be similarly machined of more costly brass.

Figure 3A:
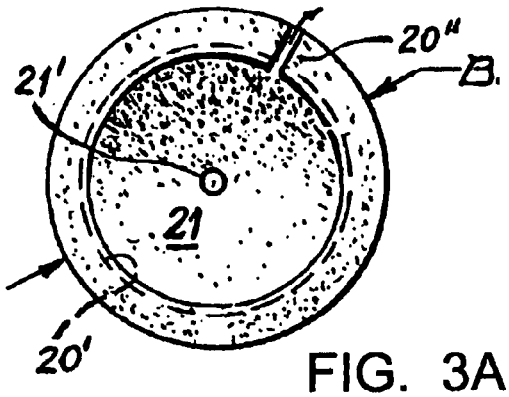
FIG. 3A, is a bottom/plan-view thereof, showing an underside cavity.
Figure 3B:
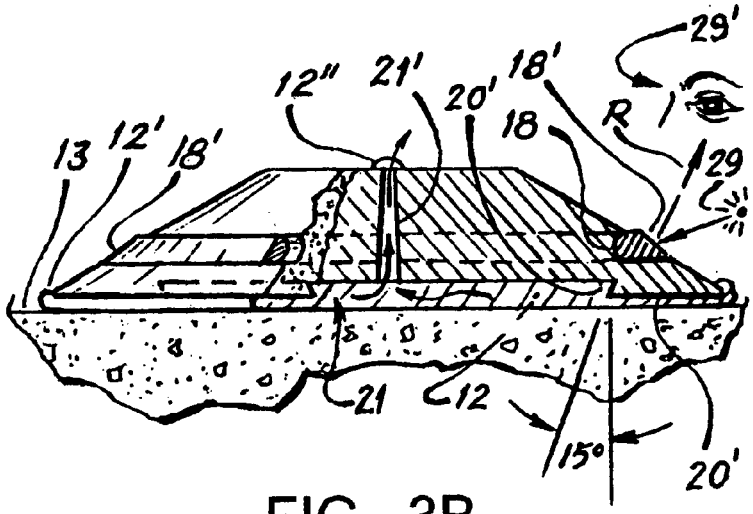
FIG. 3B, is an 2×-enlarged partial cross-section thereof, taken along reference-plane 3B:3B in FIG. 3A.

There remain subtle, however vital other differences which are to become herein more evident and understood as important improvements. For example, FIGS. 3A/3B show how adherence of the safety-button devices can be enhanced by optional molding of the underside to form an integral annular-boss 21 preferably having an inside annular-declivity 21' (ie: undercut ledge formation) of approximately 7-degree to 15-degree angle as so depicted in FIG. 3B. During installation, the gooey adhesive-glue bonding-agent general substrate 13 is subjected to a manual downward pressure applied to upper-side of the safety-button, forcing a small dab of the oozing bonding-agent to flow into this crevice like annular-declivity 20' prior to its attaining a permanently hardened condition. This annular-declivity 20' preferably serves in combination with perimeter outflow-bead 12' to increase retention of the safety-button owing the in effect mechanical-engagement of the subsequently hardened bonding-agent 13,—thereby supplementing natural bond-adherence of the bonding-agent occurring between the pavement-walkway surface 13 and device bottom-side 19. Also shown in FIG. 3B is optional provision of a venting-port 22' from which excess bonding-agent 13" and entrapped-air can spew; and, similarly, in FIG. 3A is shown an alternate optional arrangement of one or more spew-channels 20" from which excess bonding-agent and entrapped-air may escape. Another optional feature revealed in FIG. 3B only, is a simple retro-reflective plastic ring member 18' which outwardly exposed portion has a reflective-coating, and which ring 18' is sized as to snap tightly into an annular-groove 18; thereby serving the function of reflecting either ambient-light or a motorist's headlights toward an exemplified onlooker's eye 29' as demonstrated by reflective light-incidence ref.-arrow R. The notion here being that while but a single so equipped safety-button is in of itself insufficient to attract much attention, the cumulative effect of the aggregate installation of dozens of such radiating retro-reflective safety-buttons can be visually alarming;—and owing their snap-on retention, the individual rings can be replaced by new ones if their reflective quality diminishes over a period of time.

Figure 1B:
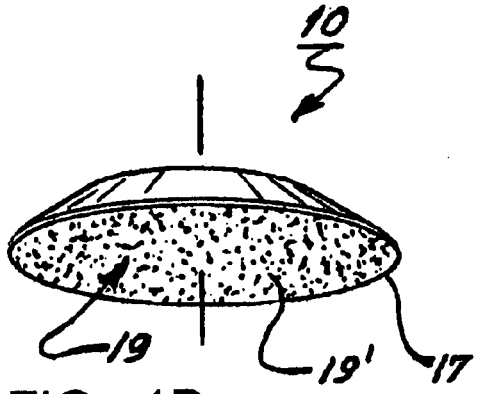
FIG. 1B, is a lower-oblique pictorial-view showing the bottom side thereof.
Figure 1C:
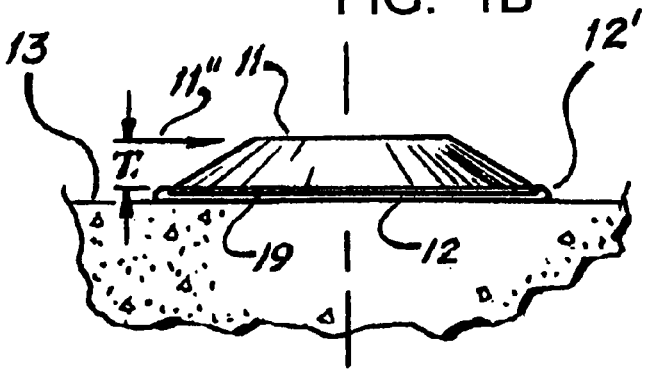
FIG. 1C, is a side/elevation-view thereof.
Figure 5:
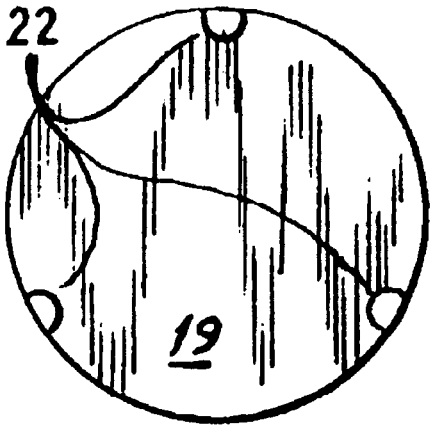
FIG. 5, is a bottom/plan-view showing a triad of stabilizing pads.
Figure 6:
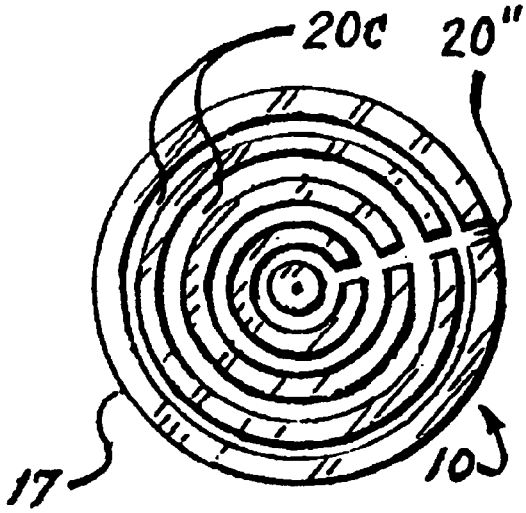
FIG. 6, is a bottom/plan-view showing optional circumferential channels.

In the example of FIG. 5 is shown how the purely planar bottom-side embodiment of FIG. 1B can optionally be formed with a triad of equidistantly spaced apart integral elevating-teats 22, which approximate 1/16-inch thickness serves upon the presence of relatively rough and irregular pavement-walkways (such as gravel imbeded blacktop) to establish a levelizing effect, thereby advantageously functioning substantially in the manner of a 3-legged stool,—always resting solid regardless as to the condition of surface 14. Another optional structural variant by which to attain increased retention in revealed in FIG. 6, wherein concentric or circumferential-grooves 20C act to receive the bonding-agent 12 and effectively increase the available bonding-surface area presented by the safety-button 10, and thereby attaining an enhanced adhesion upon the pavement-walkway surface 13 exemplified in FIG. 1C.

Figure 2A:
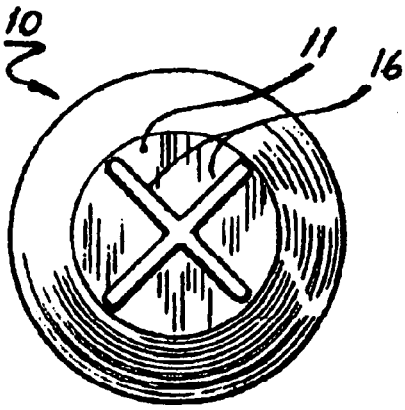
FIG. 2A, is a top/plan-view thereof, showing an anti-slip provision.
Figure 2B:
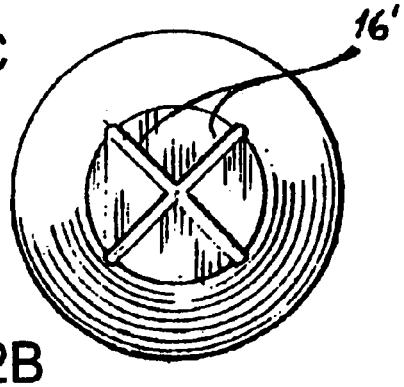
FIG. 2B, is a alternate top/plan-view thereof.
Figure 2C:
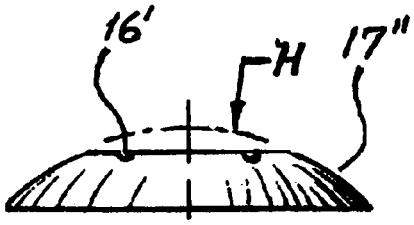
FIG. 2C, is a side/elevation-view thereof, showing an arched sidewall.

Reference to FIGS. 2A/2B/2C shows how the basic safety-button 10 of FIG. 1A may also be molded with either a raised 16 or recessed 16' preferably X-shaped traction enhancing formation, which provision serves to enhance the coefficient-of-friction of a pedestrian's foot-ware thereon,—particularly during inclement weather (or otherwise in the case of new slick-leather soles for example). Also note in FIG. 1C how the regularly circular and straight-beveled sidewall 17' can optionally be formed as an arc'ed bevel 17" as shown in FIG. 2C;—and is thus substantially hemispherical as shown by Ref.-arrow H in FIG. 2C, which is thus largely an aesthetic feature rather than one of particular functional significance.

Figure 4A:
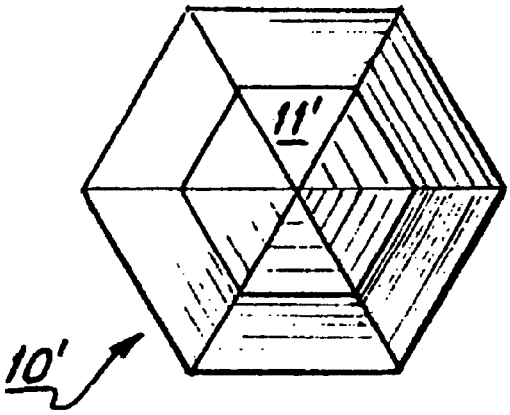
FIG. 4A, is an top/plan-view showing a generic-variant regular-polyhedron.
Figure 4B:
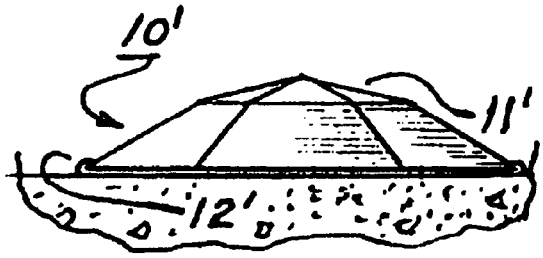
FIG. 4B, is a side/elevation-view thereof.

Another optional iteration of my safety-button, is revealed by the chiseled looking faceted embodiment presented in FIGS. 4A/4B, wherein is shown a regular-hexagonal shape, made further variant by presence of optionally non-planar hex-peak 12'. Accordingly, any such faceted variant from a pure circular formation species, are herein generally regarded as of a quasi pyramid like regular-polyhedron generic-variant species configuration, nevertheless tantamountly serving the same detectable-dome purpose as that of the "basic" embodiment of initial FIG. 1A.

Figure 7A:
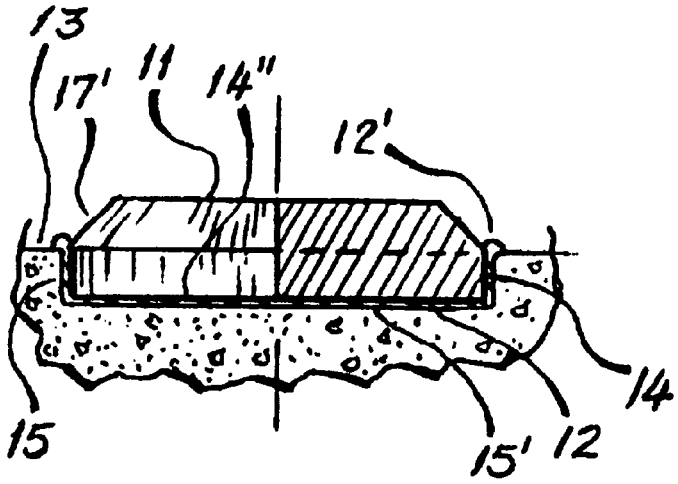
FIG. 7A, is partially cut-away view, showing a super-retention generic-variant.
Figure 7B:
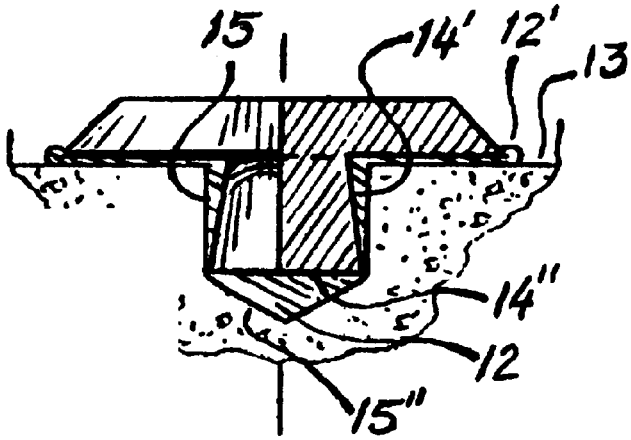
FIG. 7B, is a cross-sectional view, showing a friction-fitted version thereof.

Next, the generic-variant embodiments of FIGS. 7A/7B is an optional super-retention version of my basic FIG. 1A detectable-warning safety-button device 10, here however including an additional downwardly extended subterranean-boss portion 14, which boss is entirely concealed once installed. Intended primarily for those applications where extremely heavy foot-traffic is encountered, the preparation merely involves pre-drilling of the existing hard-concrete 13 by use of a conventional preferably V-tipped carbide or diamond drill-tool,—resulting in a characteristic Vee'd bottom occlusion 15" and a vertical-walled subterranean retention-hole 15 of FIG. 7B; while FIG. 7A shows an alternate flat-bottom 15' achieved via a conventional flat-counterbore type of rotary-drill. Hence, the iteration of FIG. 7A employs a relatively shallow preferably full-breadth vertical-wailed subterranean-boss portion 14', preferably nominally only about an 1/8-inch to maximum of 1/4"-Inch in downward extension. This subterranean-boss thus abuts down against the bottom perimeter 15" of vertically-walled receiving-hole 15 of the same approximate depth, thereby limiting insertion as to maintain proper rise as shown above the pavement-walkway surface 13;—as earlier established in FIG. 1C. A hole-diameter sized as to provide either an interference press-fit/friction-fit alone can be relied upon,—or more preferably a mere slip-fit, if a conventional epoxy-type bonding-agent 12 is employed as with my previously shown embodiments.

Alternately, if contemplating installation of my super-retention safety-button device as part of an entirely new concrete pavement-walkway, an equivalent retention-hole 15 may be readily prepared by means of a simple prong tip 26' which is manually pressed into the otherwise finished albeit still reformable wet-cement surface 13". The basic mono-pronged tool of FIG. 8A includes a handle 25 preferably with an elongate extension-shaft portion 25', plus an annular-abutment or radial-flange portion 25" which face serves to abut surface 13 of the wet-cement 13", as to thereby limit penetration of prong-tip 26'; hence, resulting in retention-hole 15 being formed consistantly to the desired predetermined depth.

Figure 8A:
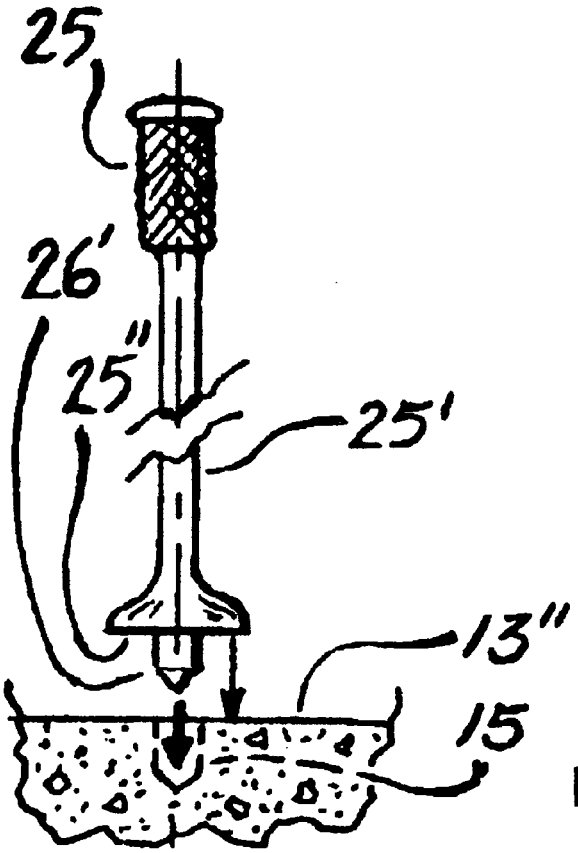
FIG. 8A, is side/elevation-view showing a mono-prong embossing-tool.
Figure 8B:
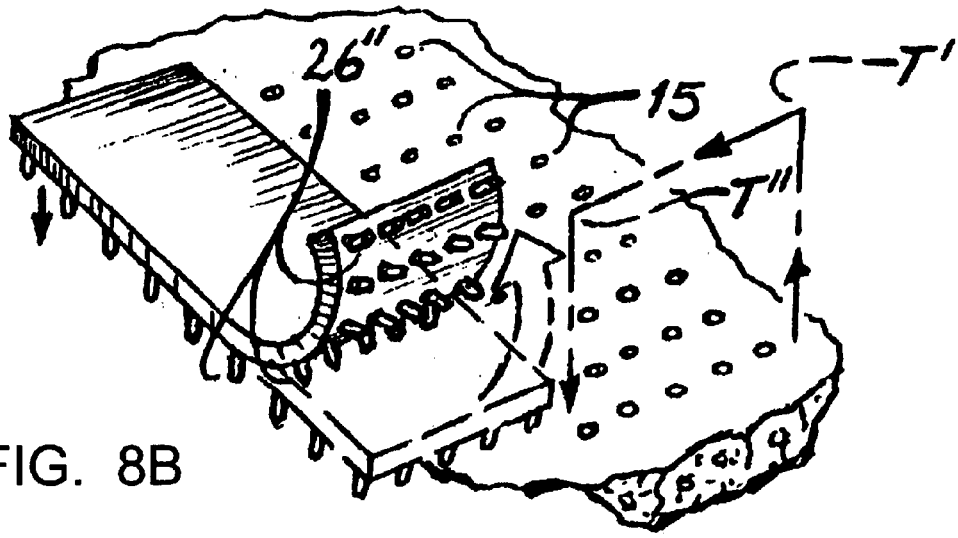
FIG. 8B, is a composite picture showing my multi-pronged embossing-tools.

A related procedure is further set forth in FIG. 8B, wherein is exemplified a multi-pronged so-called tamping-platen which can be constructed either rigid 27 (of plywood or fiberglass) or semi-flexible 27' (of 1"-thicklaminated rubber for example), so as to thereby be utilized substantially in the otherwise well known conventional procedure of tamping or embossing simulated brick and cobble-stone impressions into wet-cement. The herein exemplified plurality of prongs 26" are prearranged upon the tamping-platen in a properly spaced apart format as prescribed by the ADA or DOT regulations. Thus my special tamping-platen 27 (or 27') is carefully set in place upon an initially selected portion of a pavement-walkway to be thereby prong-embossed, whereby the downwardly interfacing tamping-platen 27 is pressed firmly into the wet-cement 13" until the platen-face 27" abuts upon the cement's upper-surface 13 (much as demonstrated with the annular-abutment 19" in FIG. 8A). At this stage, the tamping-platen 27 is vertically withdrawn (action ref.arrow-T') entirely leaving the plural impressions 15 as indicated in FIG. 8B;—whereupon in FIG. 8B the tamping-platen is immediately shifted to a precisely adjoining position—(action ref.arrow-T'),—and so on until the requisite area demarkation is completed.

Figure 9:
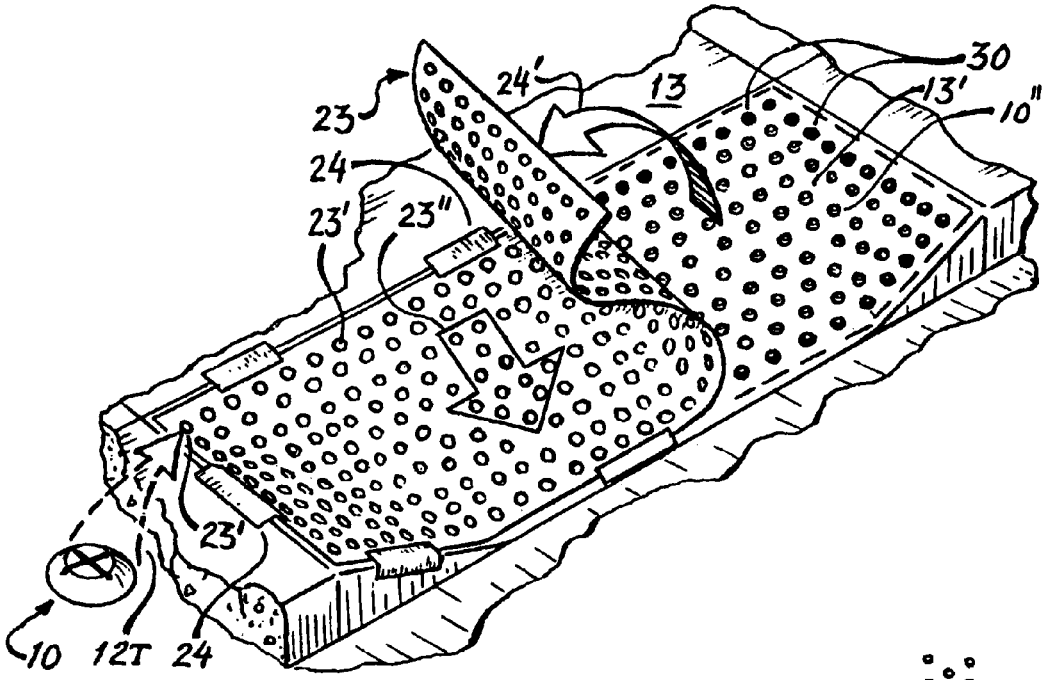
FIG. 9 is a pictorial-view exemplifying a sidewalk-ramp installation.

In so far as uniform installation of my non-subterranean type safety-buttons is concerned, all such iterations are preferably installed with the optional assistance of my time-saving layout-stencil. Therefore, in FIG. 9 is shown how my special layout-stencil 23 is laid upon an existing pavement-walkway area 13 exemplifying a common curb-ramp, where it is temporarily held in place preferably by outlining placement of conventional duct-tape referred to herein as positioning-tape 24. The factory-made matrix-holes 23' of my layout-stencil 23 are preferably arranged precisely according to ADA/DOT-mandates, hence facilitating a much more convenient pre-measured en'masse installation of my detectable-warning safety-buttons 10 through the stencil's numerous modular matrix-holes 23'. Note at the far left of FIG. 9 wherein phantom action ref-arrow 12T is demonstrating placement of a dab of gooey bonding-agent prior to installation of foreground safety-button 10;—and the usually reusable layout-stencil can be employed weather my safety-buttons are of the surface-bonded sort or subterrean-mounted type (matrix-hole diameters preferably being nominally the same regardless as to type of installation). In versions of my safety-buttons 10 which are of the type requiring use of an epoxy or similar bonding-agent substrate, I have found it generally most convenient to simply squeeze a dab of the gooey bonding-agent from the exemplified commercially available industrial dispenser applicator-tip 12T, directly at the center of the matrix-hole where it lands upon the desired region of the pavement-walkway surface 13. This procedure is repeated quickly as possible all over the prescribed field-area 13'. Once a dab of pre-catalyzed bonding-agent is applied into each desired matrix-holes 23', the installation-worker then simply follows-up inserting a predetermined type of safety-button there through each matrix-hole 23'; —in some cases the worker may employ one color (such as black for example) of safety-button around just the perimeter 30 of the installation field-area 13', while the main body of safety-buttons 10' so outlined may be a contrasting color (such as bright-yellow for example). The result of these novel constasting-color perimeter pieces 30 revealed in FIG. 9, is a unique visual effect facilitated by my individually installed safety-buttons 10; thus eliminating need for subsequent painting of the field-area 13' of walkway-pavement 13 with black for example if the safety-buttons 10 are yellow. And where ADA/DOT-specifications oddly call for painting of the field-area 13' the same color as the safety-buttons 10 (thereby adveresely making the truncated-domes impossible to see by those having poor-eyesight), then my novel contrasting-color of perimeter pieces 30 has all the more advantageous effect of visually distinguishing the detectable-warning zone of truncated domes.

Figure 10:
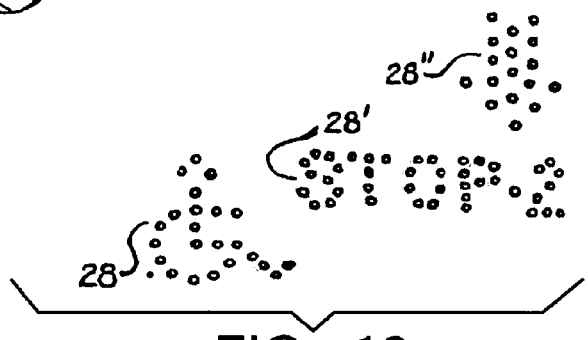
FIG. 10, is a composite picturing three typical graphic arrangements.

Additionally, FIG. 10 shows how my specialized tamping-platens of FIGS. 8A/8B can also be provided having their prongs 26" arranged to form dedicated graphic formats designed to reproduce various symbols, such as the standard stylized-wheelchair graphic designating handicap via symbol 28, or configured as alpha/numeric's 28'. here exemplified as "stop-2", or as a pedestrian pathway directional-arrow symbol 28". In such tamping-platen assisted installations, wherein the spaced apart positioning of the optional subterranean retention-holes 15 is predetermined by the fixed positioning of the prongs 26" (ref. FIG. 8B), there is no need for use of my usual stencil arranged procedure. However, FIG. 9 also reveals my exemplified layout-stencil 23 can also employ a silk-screened outline 23" which conveniently demarks a pre-selected array of matrix-holes 23' that delineates the desired graphic form (ie:—this example being a directional-arrow like 28" in FIG. 10). Accordingly, the stencil 23 may be factory silkscreened with an assortment of various such commonly known symbols, whereby the stencil may be positioned upon a pavement-walkway in such a manner that just one of these graphic-outlinings may be selected for convenient orientation upon a surface 13.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

What is claimed of proprietary inventive origin is:

1. A modular detectable-warning truncated-dome device for cautioning pedestrians traversing a walkway proximal a danger-zone; said device comprising;

a one-piece safety-button structure having a domed top-side in combination with a substantially planar bottom-side, measuring in breadth no less than ¾-inch and no more than 1 and ½-inch, while measuring in thickness no less than 3/16-inch and no more than 5/16-inch;said bottom-side provided with a bonding surface means for permanently affixing said safety-button to an existing pavement-surface via a conventional substrate bonding-agent means, and permanently arranged in a spaced apart plurality creating a co-operative foot-tactile warning-field upon an existing walkway-pavement;

said safety-button bottom-side bonding surface means is characterized as a downwardly projecting subterranean-boss portion for insertion intimately into a retention-hole prepared into said walkway-pavement surface, and including means of retention therein;

said downwardly projecting subterranean-boss portion is made substantially smaller than said safety-button breadth, whereby said bottom-side portion annular to said subterranean-boss provides a radial-extension effectively serving as an insertion-limit abutment interfacing upon said walkway-pavement surface; and said subterranean-boss portion is formed with a tapering body larger in diameter at its lower most terminus, thereby creating a captive positive-retention condition relative to said bonding-agent.

* * * * *